United States Patent [19]

Oswald et al.

[11] Patent Number: 4,467,507

[45] Date of Patent: Aug. 28, 1984

[54] APPARATUS AND METHOD FOR PRODUCING COMMINGLED CONTINUOUS VARIABLE TEXTURE YARN

[75] Inventors: Hendrikus J. Oswald, Morristown; Russell H. Butler, Rockaway; Hsin L. Li, Parsippany, all of N.J.

[73] Assignee: Allied Corporation, Morris Township, Morris County, N.J.

[21] Appl. No.: 357,376

[22] Filed: Mar. 12, 1982

[51] Int. Cl.[3] ..... D02G 1/20

[52] U.S. Cl. ..... 28/257; 28/258

[58] Field of Search ..... 28/220, 221, 255, 256, 28/257, 258, 269

[56] References Cited

U.S. PATENT DOCUMENTS

| | | | |
|---|---|---|---|
| 3,501,819 | 3/1970 | Satterwhite | 28/258 |
| 3,654,677 | 4/1972 | Binford et al. | 28/220 |
| 3,811,263 | 5/1974 | Newton | 28/258 X |
| 3,831,231 | 8/1974 | Binford et al. | 28/220 |
| 3,887,972 | 6/1975 | Bauch | 28/257 |
| 3,902,644 | 9/1975 | Bous | 28/257 X |
| 3,946,468 | 3/1976 | Satterwhite | 28/220 |
| 4,035,880 | 7/1977 | Hills et al. | 28/220 |
| 4,074,405 | 2/1978 | Li et al. | 28/257 |

FOREIGN PATENT DOCUMENTS

| | | | |
|---|---|---|---|
| 51-2533 | 1/1976 | Japan | 28/257 |
| 1381937 | 1/1975 | United Kingdom | 28/258 |

OTHER PUBLICATIONS

Peters, Application Ser. No. 753,132, filed 08/16/1968, laid open to public inspection on 04/15/1969 as noted at 861 O.G. 705.

*Primary Examiner*—Robert Mackey

*Attorney, Agent, or Firm*—Paul Yee; Ernest D. Buff; Gerhard H. Fuchs

[57] ABSTRACT

The present invention discloses a moving multicavity texturing apparatus for simultaneously texturing filaments which are commingled to form a yarn. The yarn readily knits producing a fabric which upon subsequent dyeing and shrinking produces a variable textured fabric similar in appearance to fabrics knit from natural fibers.

3 Claims, 6 Drawing Figures

APPARATUS AND METHOD FOR PRODUCING COMMINGLED CONTINUOUS VARIABLE TEXTURE YARN

DESCRIPTION

1. Field of the Invention

This invention relates to an improved apparatus and method for making continuous variable texture yarn by commingling two or more differently textured filaments.

2. Background Art

Variable texture yarn has been made by co-bulking a first continuous filament, which is commingled with a second continuous filament, in a hot fluid jet process. This technique produces co-bulked yarn with flecks of various colors randomly distributed throughout. U.S. Pat. No. 4,295,329 teaches one co-bulking technique for producing composite yarn, and notes that the toughness and the tenacity of some of the filaments is reduced by co-bulking.

SUMMARY OF INVENTION

The present invention provides a method and an apparatus whereby continuous filaments are crimped, and then commingled to form a variable textured yarn. The toughness and tenacity of the various filaments in the variable textured yarn are not reduced by the commingling step. Thus, a yarn with greater resiliency than yarn co-bulked in the prior art hot fluid jet process is obtained.

The apparatus of the present invention has at least two moving chambers with different volumes that advance at the same speed and are in thermal equilibrium. Each chamber has an inlet opening for receiving continuous filaments. A movable perforated filament-receiving means is at least partially disposed in each chamber and adjacent to the inlet opening. Each chamber has an energy tube for directing a stream of compressed fluid containing the filaments onto the filament-receiving means. The angle made between the energy tube and the filament-receiving means ranges from about 15° to 75°. Processing the continuous filaments through the chamber produces crimped or textured filaments.

Means are provided for commingling the textured filaments from each of the chambers to form a variable texture yarn.

A method for production of a variable texture yarn is described. A first group of continuous filaments is textured in a first chamber of a multi-chamber moving cavity texturing apparatus, while a second group of continuous filaments is textured in a second chamber of the same texturing apparatus. Thermal communication is maintained between the first chamber and the second chamber.

The geometry of the chambers is selected so as to assure that the difference in the skein shrinkage levels between the first group of textured filaments, and the second group of textured filaments differs by at least thirty percent (30%). The first group of textured filaments and the second group of textured filaments are commingled.

BEST MODE FOR CARRYING THE INVENTION INTO PRACTICE

Figure 1:
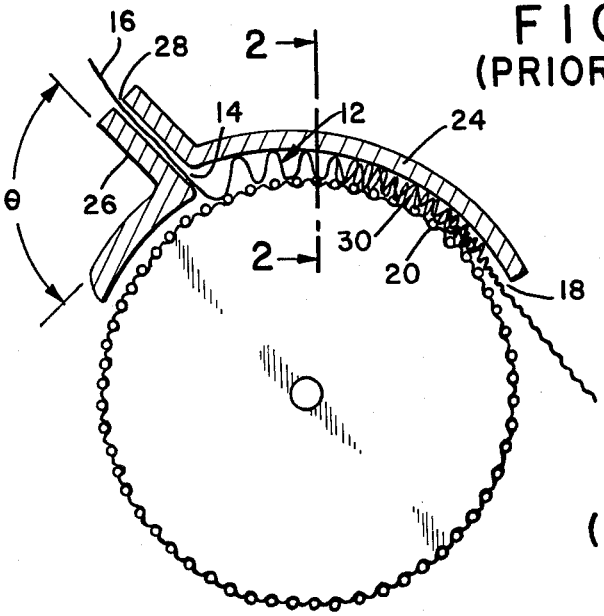
FIG. 1 (PRIOR ART)
FIG. 1 is a schematic representation of a prior art single chamber moving cavity texturing apparatus.
Figure 2:
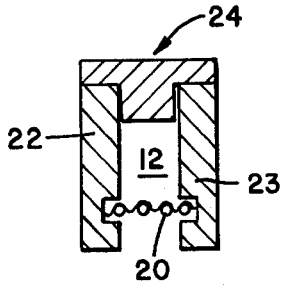
FIG. 2 (PRIOR ART)
FIG. 2 is a representation of a section taken along line 2—2 of the apparatus shown in FIG. 1.

FIG. 1 is a schematic representation of the prior art single chamber moving cavity texturing apparatus described in U.S. Pat. No. 4,074,405. The apparatus has a chamber 12 including an inlet opening 14 for receiving a group of filaments 16 to be crimped, and an outlet opening 18 for withdrawal of the filaments 16 therefrom after the filaments have been crimped on a moving perforated filament-receiving means 20 which is a screen. FIG. 2 shows the section 2—2. The perforated filament-receiving means 20 is held in place by sidewalls 22, 23. The chamber 12 is completed by a shoe 24. A group of filaments 16 is fed through an energy tube 26 by a heated compressed fluid entering through the opening 28. Advancing heated compressed fluid brings the group of filaments 16 into contact with the screen 20 which deflects the group of filaments 16, and sets a crimp in the filaments 16. The group of crimped filaments 16 are advanced in the chamber 12 by the moving perforated filament-receiving means 20 and by the residual fluid pressure and secondary crimps are introduced as the group of filaments advance into the chamber forming a plug 30. The plug 30 is advanced towards the outlet 18 by the moving perforated-filament receiving means 20. The crimped filaments are then withdrawn from the plug 30 through the outlet 18 of the chamber 12.

While the prior art provides a highly effective means for crimping filaments, the output from the prior art apparatus depends on many process parameters; such as dwell time of the plug 30 in the chamber 12, the processing temperature, the speed of the screen 20, and the angle of impact $\theta$ between the energy tube 26 and the filament-receiving means 20. The dwell time of the plug 30 will be controlled by the velocity of the screen 20, as well as, the cross section of the chamber 12. Local variations in these variables can effect the resulting crimping of the filaments 16, and can hinder subsequent commingling.

Figure 3:
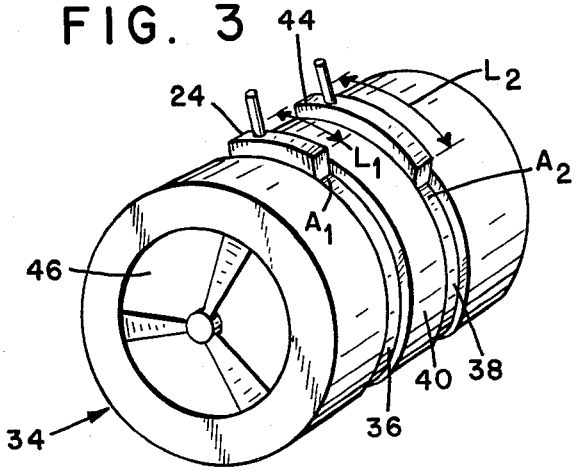
FIG. 3 is a schematic representation of a dual chamber moving cavity texturing apparatus of the present invention in which the chambers having different lengths.

FIG. 3 is a schematic representation of a two chamber crimping device having the two chambers on a common drum 34. The first chamber 36 and the second chamber 38 have equal cross sectional areas $A_1$ and $A_2$, but different lengths $L_1$ and $L_2$. The first chamber 36, and the second chamber 38 thermally communicate, and advance at the same rate. In view of this coupling of the two chambers, any systematic variation of the average crimp density in the first chamber 36 will be reflected in the second chamber 38, however, since the length of the two chambers differ there is a difference in the average crimp set for the first chamber 36, and the second chamber 38.

The first chamber 36 is as depicted for the chamber 12 in FIG. 1, the second chamber 38 shares a common sidewall 40 with the first chamber 36. The second shoe 44 of the second chamber 38 is substantially longer than the first shoe 24 of the first chamber 36. It is preferred that the second shoe 44 be at least about 50% longer than the first shoe 24. To optimize the consistency of the output from the first chamber 36 and the second chamber 38, it is preferred that the angle of impact, $\theta$ for the filaments 16 in both chambers be the same, and be between about 50° and 70°. Both the first chamber 36, and the second chamber 38 exhaust to a common exhaust chamber 46.

Figure 4:
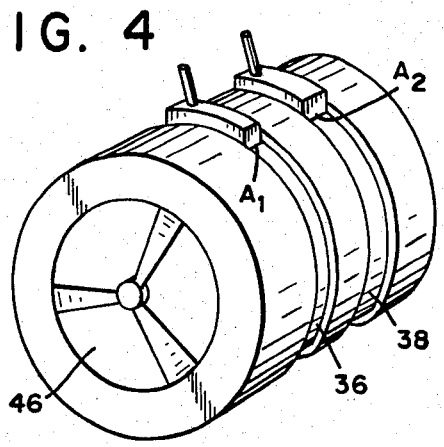
FIG. 4 is a schematic representation of the dual chamber texturing apparatus of the present invention in which the chambers have different cross sectional areas.

FIG. 4 is a schematic representation of another two chamber crimping device, where the first chamber 36 has a cross sectional area $A_1$, which is less than the cross sectional area $A_2$ of the second chamber 38. It is preferred that the difference in the cross sectional areas between the two chambers be at least 50%.

Both the first chamber 36, and the second chamber 38 exhaust to a common exhaust chamber 46. The two chambers because of their different geometry will produce plugs 30 with different geometry. When the input parameters for the group of filaments 16, such as fluid temperature, fluid pressure, and angle of impact of the filaments 16 with the filament-receiving means 20, are the same for both chambers, the dwell time within the chamber 12 will be different from the two plugs. For example, dwell times greater than about 2 seconds will be ineffective in increasing the skein shrinkage for a polyethylene terephthalate yarn of 150 denier, 34 filaments. Thus, the length of the shorter chamber should be maintained such that the dwell time of the plug in the chamber will be less than 2 seconds (ie about 0.5 seconds).

Figure 5:
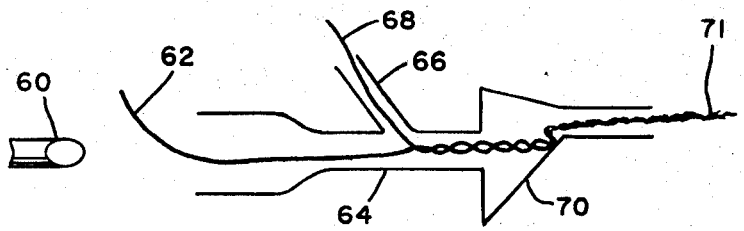
FIG. 5 is a schematic representation of a commingling apparatus for employment with the dual chamber texturing apparatus of FIG. 3 or FIG. 4 for producing a variable texture yarn.

FIG. 5 illustrates the commingling of the filaments produced by the present invention. The groups of textured filaments are withdrawn from a moving multicavity texturing apparatus. A first group of filaments 62 is withdrawn from one of the cavities and is aspirated by a high velocity jet 60. The jet 60 propels the first group of filaments 62 down the aspirator tube 64. An inlet 66 is provided for the introduction of a second group of filaments 68. These filaments are withdrawn at the same rate as the first group of filaments 62 were withdrawn from the multicavity texturing apparatus. The groups of filament are impacted against a wall 70 to commingle the filaments and produce a yarn 71 of uniform texture. Further details of this commingling technique is discussed in U.S. Pat. No. 3,874,044. The uniform texture yarn produced by this technique is easily woven, and upon subsequent dyeing and shrinking the woven material has an appearance similar to that of natural fibers, such as wool or cotton.

Figure 6:
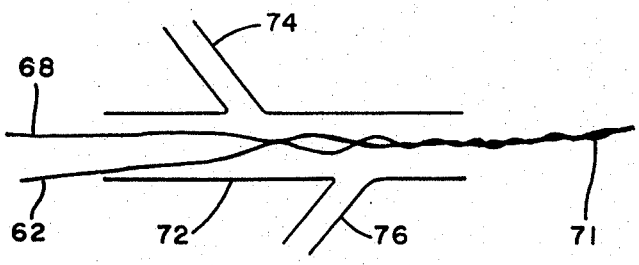
FIG. 6 is a schematic representation of a second commingling apparatus for employment with the dual chamber texturing apparatus of FIG. 3 or FIG. 4 for producing a variable texture yarn.

FIG. 6 illustrates another commingling technique. Groups of textured filaments 62 and 68 are fed at the same rate into a tube 72. The tube 72 has a first jet inlet 74 which directs a fluid into the tube 72, and a second jet inlet 76 which also directs fluid into the tube 72. The two jet inlets 72, 76 are off center and provide turbulent flow in the tube 72. The turbulent flow causes commingling of the filaments, and thereby a uniform yarn 71 to be produced. This yarn can be easily woven, and upon subsequent processing will produce a woven material with a textured appearance similar to that of natural fibers.

Other commingling techniques are described in U.S. Pat. No. 2,985,995.

What we claim is:

1. An apparatus for producing variable textured continuous filament yarn, comprising:

a first chamber having sidewalls, a first inlet opening for receiving a first group of filaments, and an outlet for withdrawing said first group of filaments, said first chamber having a finite volume;

a first movable perforated filament-receiving means disposed in said first chamber adjacent to said inlet opening;

a first fluid directing means having an angular disposition relative to said first filament-receiving means for directing a stream of a compressed fluid containing said first group of filaments into contact with said first filament-receiving means to initiate crimping thereof, the angle of disposition ranging from about 15° to 75°;

a second chamber having sidewalls and having an inlet opening for receiving a second group of filaments, said second chamber having a volume at least 50% greater than said first chamber volume and one of said sidewalls of said second chamber being common with one of said sidewalls of the first chamber;

a second movable perforated filament-receiving means disposed in said second chamber adjacent to said second inlet opening and moveable at the same rate as said first filament receiving means;

a second fluid directing means having an angular disposition relative to said second filament-receiving means for injecting a stream of a compressed fluid containing said second group of filaments into contact with said second filament-receiving means to initiate crimping thereof, and to provide a shrinkage of said second group of filaments which differs from the shrinkage of said first group of filaments by at least 30%, the angle of disposition of said second fluid directing means being the same as the angular disposition of said first fluid directing means; and means for commingling said first group of filaments and said second group of filaments to form yarn.

2. The apparatus of claim 1 wherein said first chamber and said second chamber have lengths which are equal.

3. The apparatus of claim 1 wherein said first chamber has a length less than the length of the second chamber, and the two chambers have cross sectional areas which are the same.

* * * * *